United States Patent [19]

Shirai et al.

[11] Patent Number: 5,018,379

[45] Date of Patent: May 28, 1991

[54] APPARATUS AND METHOD FOR CRIMPING END OF CAN BODY

[75] Inventors: Keiichi Shirai; Akira Kawaguchi; Sunao Kitazima, all of Hyogo, Japan

[73] Assignee: Mitsubishi Metal Corporation, Tokyo, Japan

[21] Appl. No.: 481,201

[22] Filed: Feb. 20, 1990

[30] Foreign Application Priority Data

Feb. 22, 1989 [JP] Japan ..... 1-42088
Feb. 23, 1989 [JP] Japan ..... 1-20581[U]

[51] Int. Cl.[5] ..... B21D 51/26; B21D 41/04

[52] U.S. Cl. ..... 72/354.6; 72/94; 72/370; 72/391.2; 413/69

[58] Field of Search ..... 72/354, 391, 370, 94, 72/354.6; 43/69

[56] References Cited

U.S. PATENT DOCUMENTS

| | | | |
|---|---|---|---|
| 3,581,542 | 6/1971 | Wahler | 72/94 |
| 3,757,558 | 9/1973 | Heinle | 72/354 |
| 3,812,696 | 5/1974 | Kneusel et al. | 413/69 |
| 3,983,729 | 10/1976 | Traczyk et al. | 413/69 |
| 4,030,432 | 6/1977 | Miller et al. | 413/69 |
| 4,446,714 | 5/1984 | Cvacho | 72/354 |
| 4,732,027 | 3/1988 | Traczyk et al. | 413/69 |
| 4,774,839 | 10/1988 | Caleffi | 72/354 |

FOREIGN PATENT DOCUMENTS

| | | |
|---|---|---|
| 0298230 | 1/1989 | European Pat. Off. . |
| 2602262 | 7/1976 | Fed. Rep. of Germany . |
| 2163986 | 3/1986 | United Kingdom . |

*Primary Examiner*—Robert L. Spruill

*Attorney, Agent, or Firm*—Oblon, Spivak, McClelland, Maier & Neustadt

[57] ABSTRACT

There is disclosed a method for crimping an open end of a can body. A male die is inserted into the can body through the open end in such a manner as to be coaxial therewith. Then, the female die is caused to fit on the opening end, and the female die is kept moving along the outer peripheral surface of the male die while moving the male die, inserted into the can body, in a releasing direction from the can body. Thus, the opening end is crimped by the relative movement of the male and female dies. There is also disclosed a crimping apparatus which includes at least one crimping mechanism, a holder for holding the can body at a prescribed position, a complex cam and a drive mechanism. The crimping mechanism includes male and female dies, follower members connected to the male and female dies, respectively. The cam includes first and second cam faces with which the first and second follower members are respectively held in engagement. The drive mechanism is operable to move the first and second followers along the first and second cam faces to move the first and second follower members axially of the male and female dies in a prescribed manner.

16 Claims, 7 Drawing Sheets

APPARATUS AND METHOD FOR CRIMPING END OF CAN BODY

BACKGROUND OF THE INVENTION

1. Field of the Invention

The present invention pertains to a method and apparatus for crimping ends of can bodies utilized in cans for beverages or the like.

2. Description of the Prior Art

When manufacturing an aluminum can for beverages, a crimping operation is carried out on the open end of a cylindrical can body having a bottom, which is manufactured by deep drawing, to form a plurality of crimps thereat. The crimps are provided in order to reduce the diameter of the top end to be fitted over the open end of the cylindrical can body, which is great in thickness and hence high in cost, resulting in the reduction in total manufacturing cost of the can.

The crimping operation has hitherto been conducted in a manner as shown in FIG. 1, in which the numeral 1 denotes a male die of a cylindrical shape, while the numeral 2 denotes a female die disposed coaxially around the male die 1 with a gap formed therebetween. The female die 2 is provided with a tapered surface 2A formed on an inner surface thereof to reduce the diameter of the can body at the open end thereof.

The male die 1 and the female die 2 are simultaneously moved forward as illustrated in FIG. 1(*a*). Then, the male die 1 is stopped when a prescribed length of the male die 1 enters the can body K as illustrated in FIG. 1(*b*), while the female die 2 is further moved to cause the tapered surface 2A to engagingly fit on the can body K. With this procedure, the open end of the can body K is gradually reduced in diameter, and is moved longitudinally along an outer peripheral surface of the male die 1, which is in a stationary state, to thereby produce a reduced-diameter portion as illustrated in FIG. 1(*c*). Thereafter, the female die 2 and the male die 1 are both moved backward when the length of the reduced-diameter portion reaches a prescribed value, and the can body K is conveyed to the next step as illustrated in FIG. 1(*d*). The repetition of the aforesaid procedure results in the formation of a plurality of crimps in the can body K and the reduction of the diameter at its open end.

A conventional apparatus for practicing the aforesaid method includes a crimping mechanism comprised of inner and outer cylinders for supporting the male and female dies 1 and 2, respectively, for sliding movement. One of the conventional crimping mechanisms is constructed so as to work as follows. First, only the outer cylinder is driven by a single cam while keeping the inner cylinder pressed against a forward end portion of the outer cylinder by means of a spring or the like, and when the outer cylinder advances a prescribed length, only the outer cylinder is caused to advance a prescribed length while preventing the movement of the inner cylinder by means of a stopper. Thereafter, the outer cylinder is caused to move backwards together with the inner cylinder. In another crimping mechanism, the male die 1 and the can body K are driven by separate drive sources while keeping the female die 2 stationary, to thereby carry out the method as illustrated in FIG. 1.

In the aforesaid crimping method, however, when the open end of the can body K is reduced in diameter by the female die 2 to extend along the outer peripheral surface of the male die 1 a friction force is exerted on the male die 1 and the extended portion of the can body in a opposite directions, so that there may occur wrinkles or buckles in the reduced portion due to the friction. Therefore, if the thickness of the wall of the can body K is reduced or if the working speed of the manufacturing apparatus is increased, defects such as wrinkles and buckles tend to occur more frequently, and hence it is difficult to lower manufacturing costs by reduction of the thickness of top end K, and it is also difficult to increase productivity by speeding up processing.

A more complete appreciation of the invention and many of the attendant advantages thereof will be readily obtained as the same becomes better understood by reference to the following detailed description when considered in connection with the accompanying drawings, wherein:

Specifically, in the mechanism which drives the inner and outer cylinders by a single cam, the aforesaid disadvantage cannot be avoided, whereas in the mechanism which drives the male and female dies 1 and 2 separately, it has bee difficult to completely synchronize the movement of these dies to move them at a precise amount of movement and speed, resulting in low operational precision and reliability. Furthermore, since separate drive sources are provided for the male and female dies 1 and 2, respectively, the apparatus is of an intricate construction, resulting in high costs.

SUMMARY OF THE INVENTION

It is therefore an object of the present invention to provide a method for crimping open ends of can bodies which can crimp ends of can bodies without causing any wrinkles or buckles thereon, to thereby enable the use of thin can bodies and to increase the crimping speed substantially.

Another object of the invention is to provide an apparatus for crimping ends of can bodies which is suitably employed to practice the aforesaid method, and which is of a relatively simple construction.

According to a first aspect of the invention, there is provided a method for crimping an open end of a can body by using a male die having a diameter smaller than the diameter of the can body and a female die having a processing surface for crimping the open end, comprising the steps of inserting the male die into the can body through the open end in such a manner as to be coaxial therewith; causing the female die to fit on the opening end, and keeping the female die moving along the outer peripheral surface of the male die while moving the male die, inserted into the can body, in a releasing direction from the can body, whereby the opening end is crimped by the relative movement of the male and female dies so as to have a reduced diameter; and releasing the male and female dies out of the can body.

According to a second aspect of the invention, there is provided an apparatus for crimping an open end of a can body of a prescribed diameter, comprising at least one crimping means including a cylindrical male die having a diameter smaller than the can body and adapted to be inserted into the can body through the open end, a cylindrical female die disposed generally coaxially with the male die and having a processing surface for processing the open end of the can body, and first and second follower members connected to the male and female dies, respectively; holding means disposed adjacent to the at least one crimping means for holding the can body in such a position that the open end of the can body is opposed to the male and female dies in generally coaxial relation therewith; cam means associated with the first and second follower members of the at least one crimping means, the cam means having first and second cam faces with which the first and second follower members are respectively held in engagement; and drive means operably connected to the at least one crimping means for moving the first and second followers along the first and second cam faces to move the first and second follower members axially of the male and female dies in a prescribed manner.

DESCRIPTION OF THE PREFERRED EMBODIMENTS OF THE INVENTION

Figure 1A:
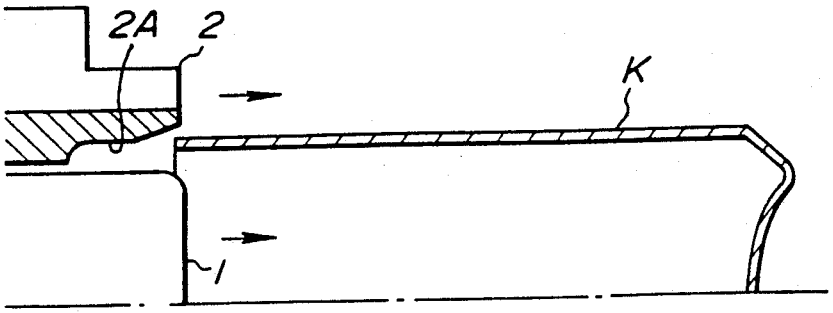
FIG. 1a PRIOR ART
FIG. 1(*a*)–(*d*) is a schematic cross-sectional view for explaining a conventional crimping method.
Figure 1B:
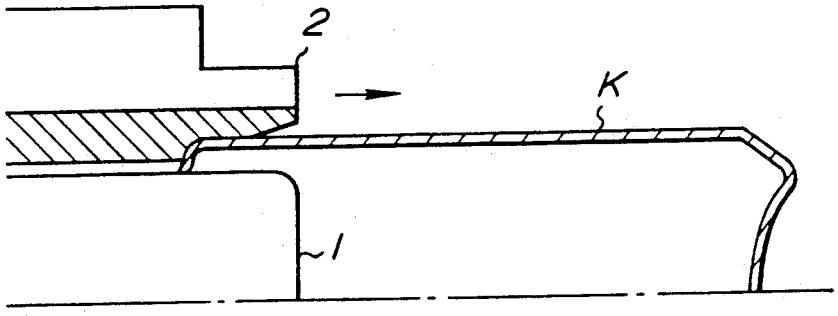
FIG. 1b PRIOR ART
Figure 1C:
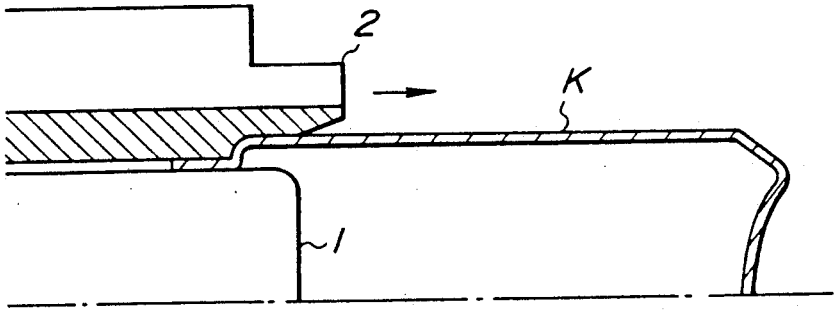
FIG. 1c PRIOR ART
Figure 1D:
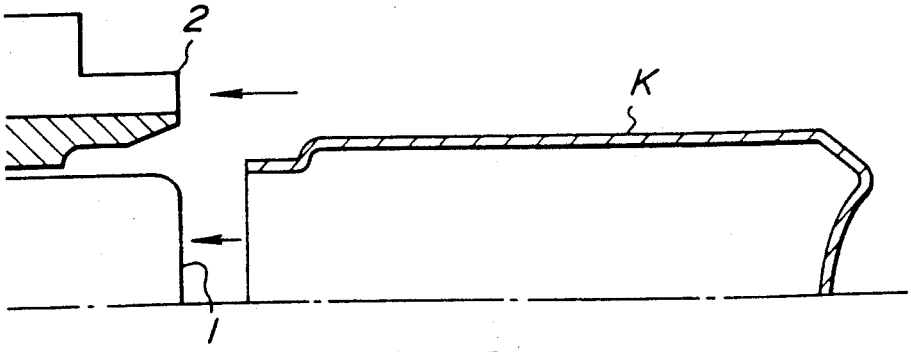
FIG. 1d PRIOR ART
Figure 2:
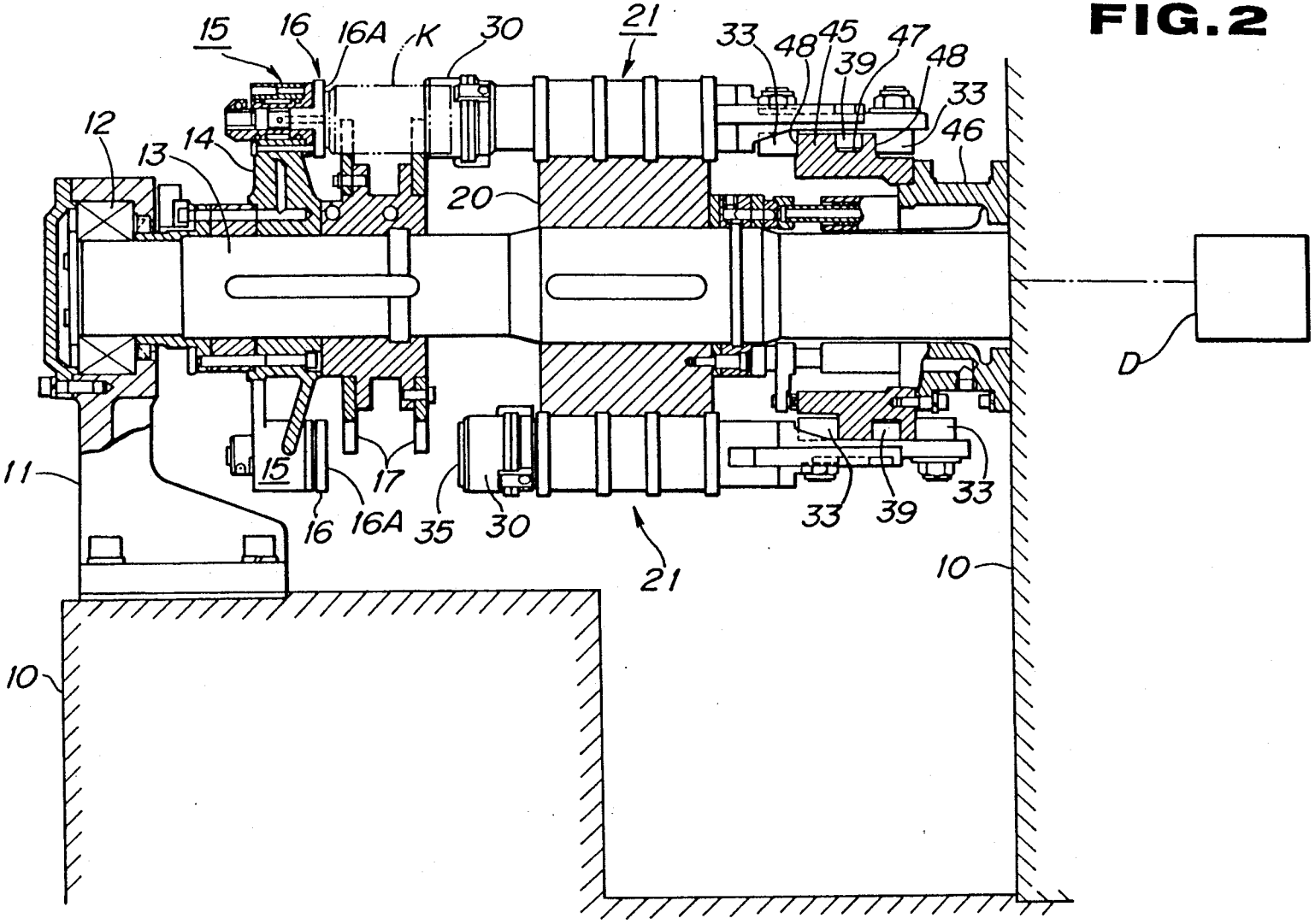
FIG. 2 is a cross-sectional view of a crimping apparatus in accordance with the present invention.

FIG. 2 depicts a crimping apparatus in accordance with an embodiment of the present invention, in which left and right hand sides are referred to as forward and rearward sides, respectively, for the sake of convenience for explanation.

In the drawing, the numeral 10 denotes a base having a standard 11 disposed at its forward end and fixedly secured thereto. A rotary shaft 13 is generally horizontally supported thereon with its forward end portion supported on the standard 11 through a bearing 12 and with its rearward end portion being extended through the base 10 and being fixedly secured to a drive mechanism D, which is operable to rotate the rotary shaft 13 at a constant speed.

A first annular support member 14 is coaxially disposed around and securely fixed to the rotary shaft 13 at its forward portion, and a plurality of horizontally-extending can-body holding mechanisms 15 are securely fixed to the support member 14 in circumferentially equally spaced relation to one another. Each of the can-body holding mechanisms 15 is provided with a vacuum plate 16 facing rearwardly and connected to an evacuation apparatus (not shown), so that evacuation is carried out from an end face 16A of the vacuum plate 16. The end face 16A is formed in conformity with a closed end of the can body K, and hence the end of the can body K can be held in close contact with the vacuum plate 16 and be clamped securely and held horizontally. In addition, a pair of forward and rearward can-body support plates 17 ar disposed adjacent to the support member 14 and securely fixed to the rotary shaft 13 to support the outer periphery of the can body K. Thus, the first support member 14, the can-body holding mechanisms 15 and so on constitute holding means for holding the can bodies K at prescribed positions.

Furthermore, a second annular support member 20 is coaxially disposed around and securely fixed to the rotary shaft 13 at a position spaced rearwardly from the first support member 14 and support plates 17. A plurality of horizontally-extending crimping means or mechanisms 21 are securely fixed to the outer periphery of the second support member 20 in circumferentially equally spaced relation to one another. The crimping mechanisms 21 are disposed in opposed relation to the can-body holding mechanisms so as to correspond to them, respectively.

Figure 3:
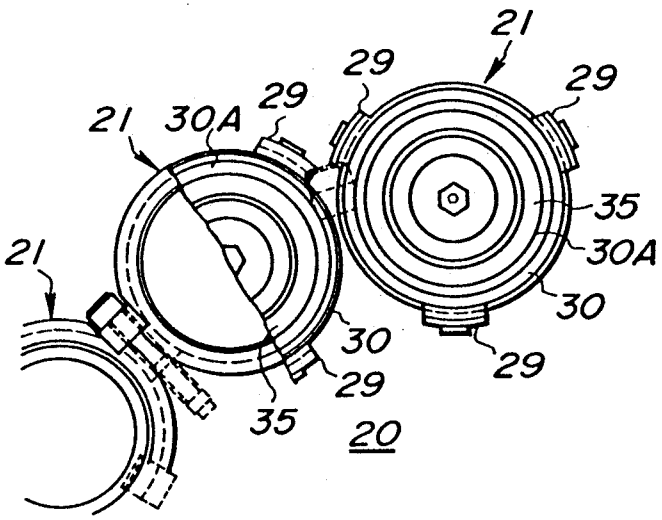
FIG. 3 is a cut-away front view of a part of the apparatus of FIG. 2.
Figure 4:
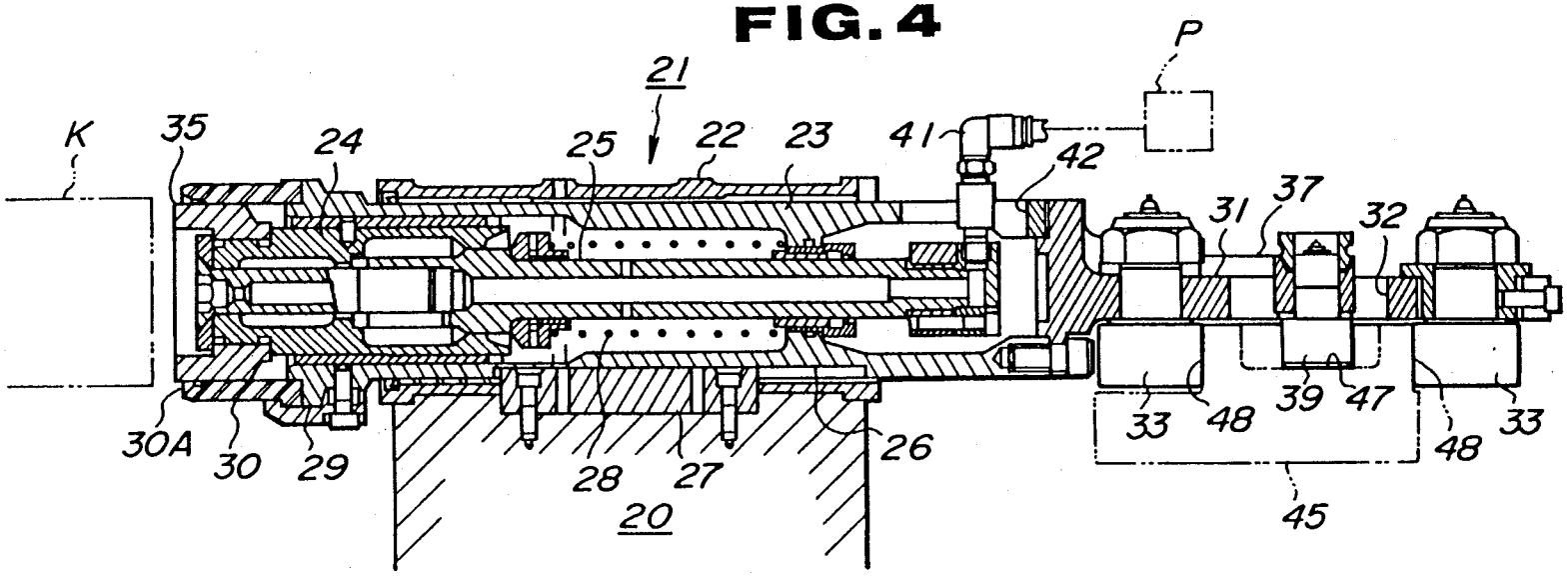
FIG. 4 is a cross-sectional view of crimping mechanisms of the apparatus of FIG. 2.
Figure 5:
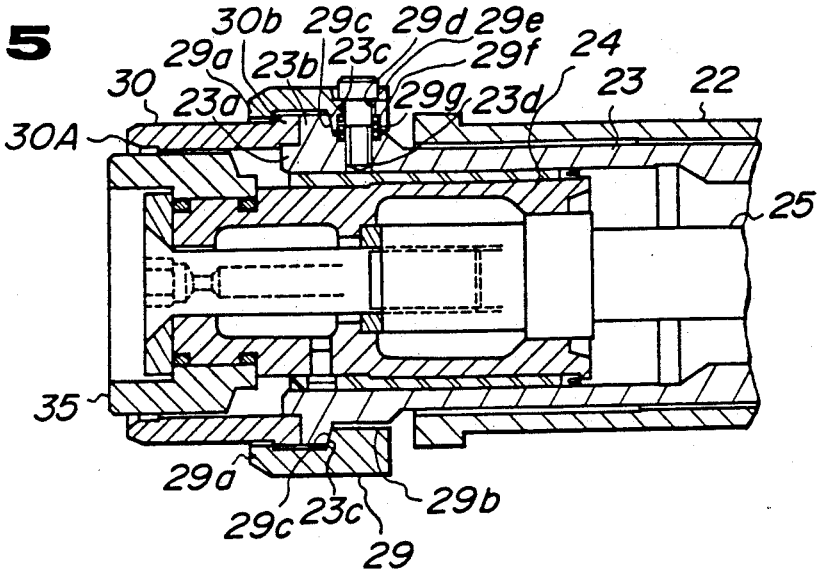
FIG. 5 is a cross-sectional view showing a detailed construction of a forward portion of the crimping mechanism of FIG. 4.
Figure 6:
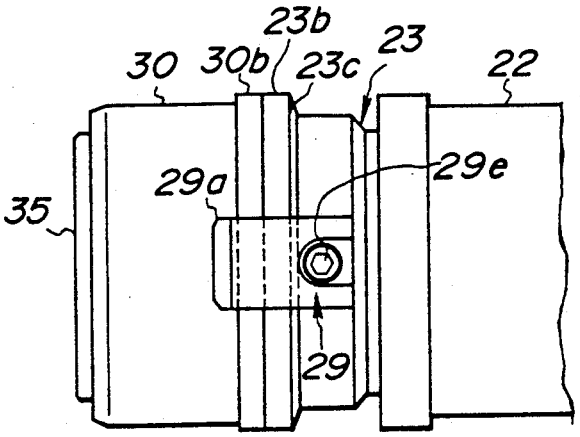
FIG. 6 is side-elevational view of the forward portion of the crimping mechanism.

As shown in FIG. 3 and FIG. 4, each of the crimping mechanisms 21 includes a hollow cylinder body 22 extending in forward and rearward directions and securely fixed to the outer periphery of the second support member 20, a hollow outer cylinder 23 accommodated in the cylinder body 22 for sliding movement therealong, a hollow inner cylinder 24 housed in the outer cylinder 23 for sliding movement therealong, and a hollow member in the form of a rod 25 securely fixed to the inner cylinder 24 so a to extend rearwardly therefrom.

Formed in the outer peripheral surface of the outer cylinder 23 is an elongated groove 26 which extends longitudinally thereof, and a parallel key 27, which is securely fixed to the supporting member 20, is received in the groove 26 to prevent the rotation of the outer cylinder during its movement in forward and rearward directions. In addition, a coil spring 28 is accommodated in the outer cylinder 23 to act between an inwardly-protruding portion of the outer cylinder and the hollow rod 25 to urge the rod 25 and the inner cylinder 24 forwardly.

Furthermore, a cylindrical male die 35 of a diameter equal to the diameter of the processed can body K is disposed at a forward position with respect to the outer cylinder 23 and is fixedly secured to the forward end of the inner cylinder 24 so as to be coaxially therewith. The outer cylinder 23 has a reduced-diameter portion 23*a* at its forward end and a larger-diameter portion 23*b* disposed adjacent to the reduced-diameter portion 23*a*, and the rearward end face of the larger-diameter portion 23*b* tapers rearwardly to define a peripheral inclined surface 23*c*. A cylindrical female die 30 is coaxially secured to the outer cylinder 23 with its rearward end portion held in abutment with the outer peripheral surface of the reduced-diameter portion 23*a* and the forward end face of the larger-diameter portion 23*b*, in such a manner that a gap generally equal to the thickness of the can body K is formed between the male and female dies 35 and 30.

The female die 30 is made of cemented carbide and is provided with a curved processing surface 30A formed at the forward end of its inner peripheral surface for reducing the open end of the can body K. The female die 30 has a peripheral protrusion 30*b* formed at its rearward end so as to extend along its entire circumference. The peripheral protrusion 30*b* has an outer diameter equal to that of the larger-diameter portion 23*b*, and the forward end face of the protrusion 30*b* extends generally perpendicular to the outer peripheral surface of the outer cylinder 23.

Figure 7:
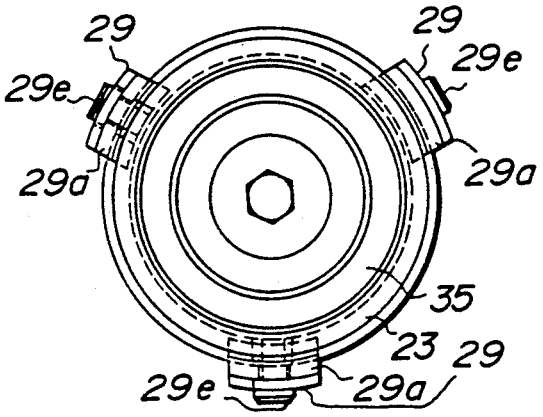
FIG. 7 is a front-elevational view of the crimping mechanism.

Furthermore, as shown in FIG. 7, three clamping claws 29 are disposed around and securely fixed to the outer peripheral surface of the outer cylinder 23 in circumferentially equally spaced relation to one another. Each clamping claw 29 has a shape of a circular cross section extending along the outer peripheral surface of the outer cylinder, and has a hook 29*a* formed at its forward end which bends inwardly therefrom at a right angle and protrudes by a distance generally equal to that of the peripheral protrusion 30*b* In addition, the clamping claw 29 has an inwardly protruding stepped portion 29*b* formed at its rearward end, and the forward end face of the stepped portion 29*b* is defined by an inclined surface 29*c* complementary to the peripheral inclined surface 23*c* of the outer cylinder 23. Thus, when the hook 29*a* hooks the protrusion 30*b* of the female die 30, the inclined surface 29*c* is held in close contact with the inclined surface 23*c* of the outer cylinder 23. In the foregoing, it is preferable that the angle defined between the inclined surface 23*c*, 29*c* and the outer peripheral surface of the outer cylinder 23 ranges from about 10° to 15°. Within this range, the securing force of the female die 30 by the hook 29*a* becomes optimal with respect to the fastening force by a screw, which will be described later.

A bore 29*d*, which is elongated in the forward and rearward directions, is formed through the stepped portion 29*b* so as to extend vertically. A fastening screw 29*d* is inserted through the bore and is screwed into an interiorly threaded aperture 23*d* formed in the outer cylinder 23. In addition, a recess is formed in the inner peripheral surface of the bore 29*d* to define a larger-diameter portion 29*f*, and a coil spring 29*g* is accommodated therein so as to be wound around the screw 29*e*, to thereby urge the clamping claw 29 radially outwardly of the outer cylinder 23.

Moreover, a rearwardly-extending connecting plate 31 is fixedly secured to the rearward end of the outer cylinder 23, and an elongated bore extending in forward and rearward directions is formed in the center of the connecting plate 31. First followers each in the form of a roller 33 are rotatably secured to the connecting plate 31 in such a manner as to face the rotary shaft 13 and to interpose the elongated bore 32 therebetween.

Figure 8:
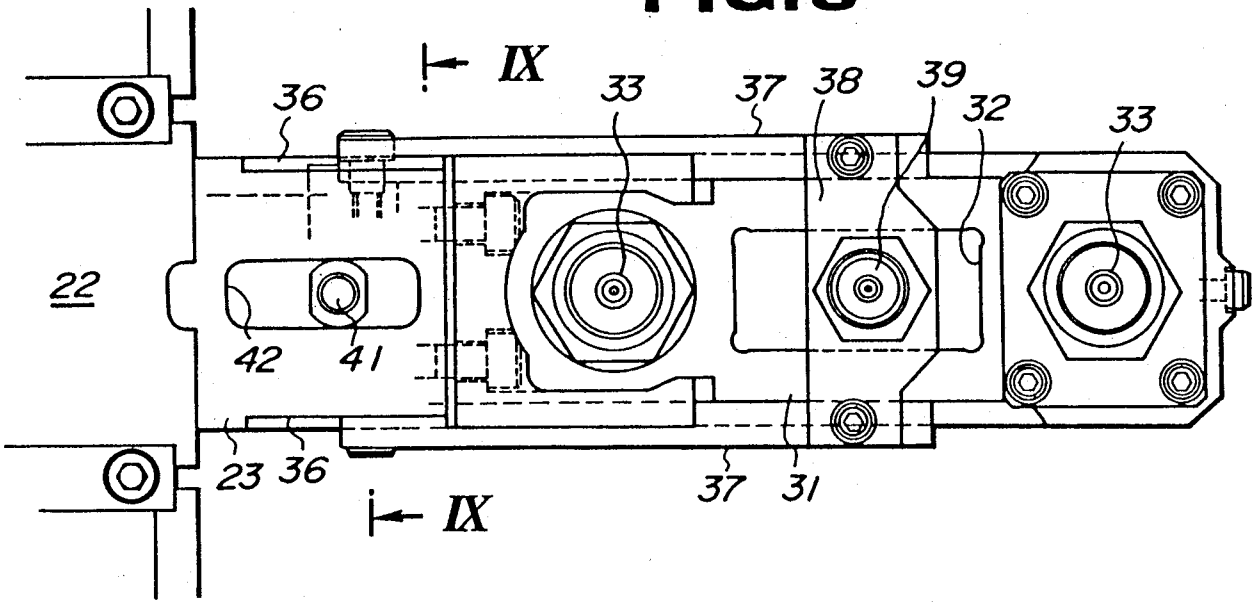
FIG. 8 is a plan view of a rearward portion of the crimping mechanism.
Figure 9:
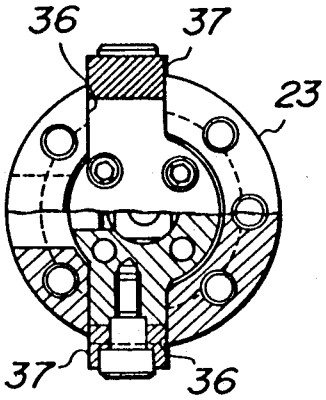
FIG. 9 is a cross-sectional view taken along the line IX—IX in FIG. 8.

As shown in FIGS. 8 and 9, a pair of rearwardly-extending openings 36 are formed in the opposite lateral sides of the outer cylinder 23, and a pair of arms 37, which are securely fixed to the opposite lateral sides of the rearward end of the hollow rod 25, are protruded through the openings 36 so as to extend rearwardly. A roller-mounting plate 38 is fixedly secured to the rearward ends of the arms 37 to connect them together, so that it is slidable along the upper face of the aforesaid connecting plate 31. A second follower in the form of a roller 39 is rotatably secured to the lower face of the roller-mounting plate 38 in opposed relation to the rotary shaft 13.

Moreover, as shown in FIG. 4, there is provided an air supply passage means in the form of a pipe 41 having one end securely fixed to the rearward end of the hollow rod 25 so as to be communicated therewith, and the other end of the pipe 41 is connected to a source P of pressurized air disposed outside the outer cylinder 23. With this construction, pressurized air is supplied from the source P through the pipe 41, the hollow rod 25 and the inner cylinder 24 into the male die 35, to thereby prevent the formation of recesses on the can body K during the crimping operation.

Furthermore, referring back to FIG. 2, an annular complex cam 45 of a large diameter is disposed coaxially with the rotary shaft 13 at a rearward position with respect to the crimping mechanisms 21 and is securely fixed to the base 10 through a cylindrical member 46. The complex cam 45 has a generally-circumferentially extending groove in its outer peripheral surface and opposite peripheral end surfaces interposing the groove and extending parallel to each other, the groove defining a male cam groove (second cam faces) 47 while the peripheral end surfaces defining female cam faces (first cam faces) 48, respectively. The male cam groove 47 extends in a prescribed curved manner and has a width generally equal to the diameter of the roller 39 while the female cam faces 48 extend in a curved manner different from that of the male cam groove 47. Thus, the second roller 39 of the crimping mechanism 21 is received in the male cam groove 47 and is held in rolling contact with the cam faces 47, and the first rollers 33 are arranged so as to be held in rolling contact with the female cam faces 48, respectively. The pairs of second rollers and the first rollers are arranged around the rotary shaft 13 in circumferentially equally spaced relation to on another. With this construction, when the rotary shaft 13 is rotated, the rollers 39 and 33 move forwards and rearwards while following the curved path defined by the cam groove 47 and cam faces 48, respectively.

Figure 10:
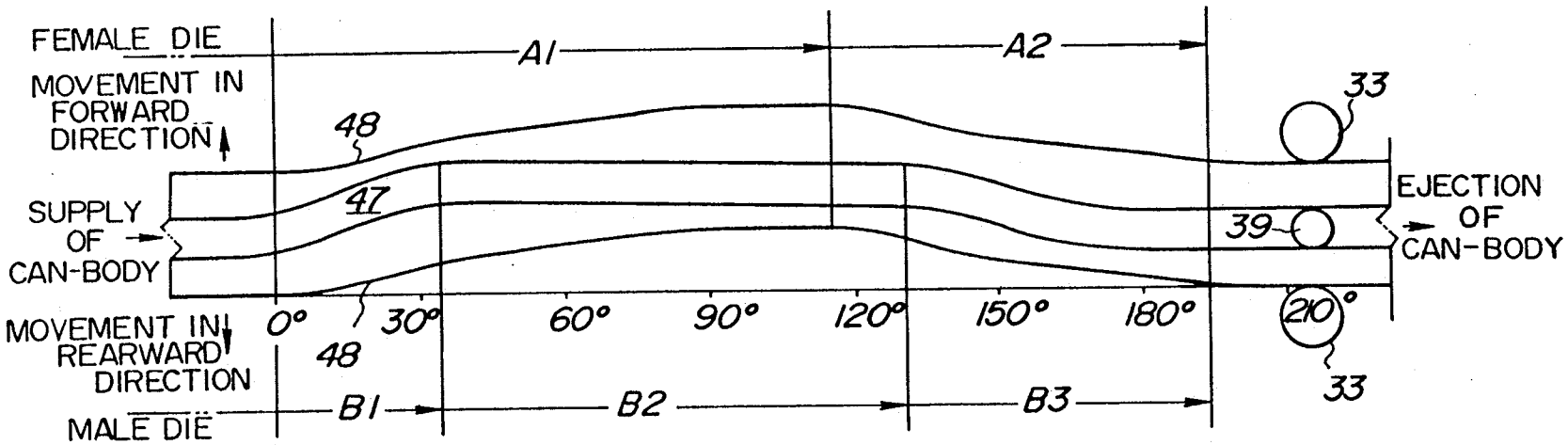
FIG. 10 is a development view of a complex cam of the apparatus of FIG. 2.
Figure 11A:
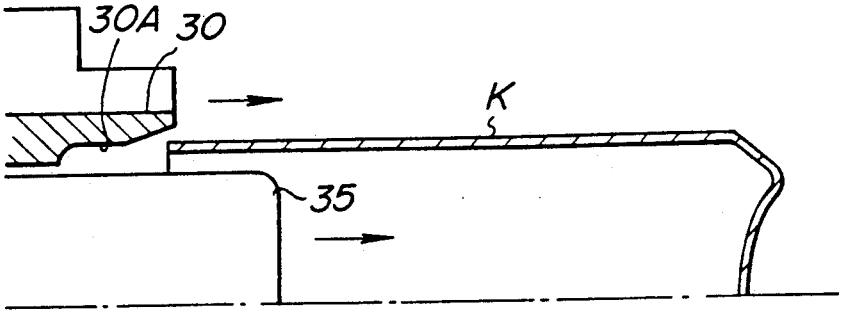
FIG. 11(*a*)–(*d*) is a schematic cross-sectional view showing a crimping method in accordance with the present invention.
Figure 11B:
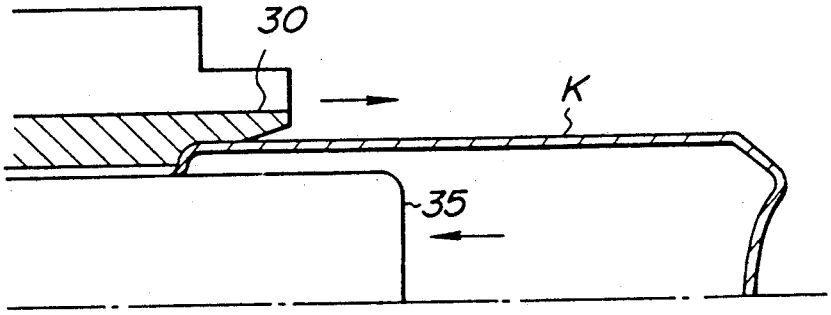
Figure 11C:
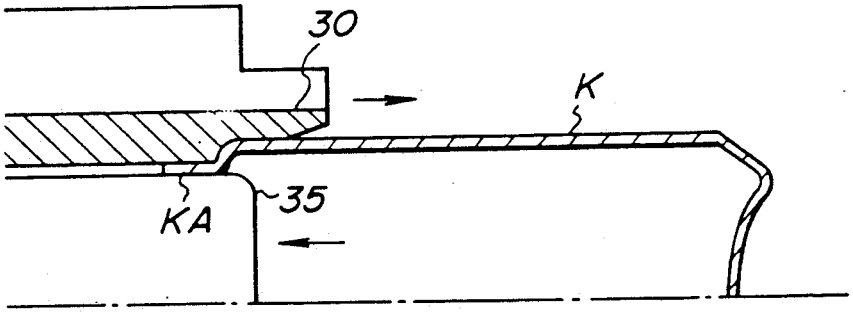
Figure 11D:
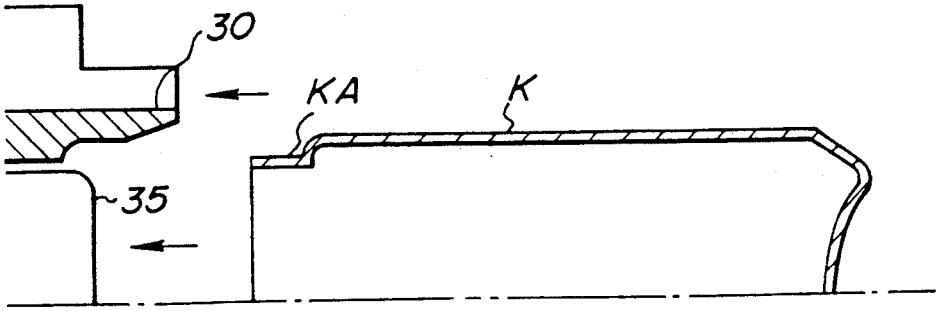

More specifically, as depicted in FIG. 10, while the female die 30 moves forwardly (A1) and rearwardly (A2) and returns to its original position, the male die 35 moves forwardly at a great speed (B1) and at a low speed (B2) and moves rearwardly (B3) and returns.

Furthermore, although not illustrated, a can-body supply device for supplying this apparatus with can-bodies K and a device of the next step for receiving the processed can bodies K are arranged adjacent to the apparatus. In relationship to the range of angle of the complex cam 45 shown in FIG. 10, the can-body supply device is arranged in the interval of 0° to 210° and is closer to 0°, while the device of the next step is arranged in the same interval but is close to 210°.

The crimping method in accordance with the present invention will now be described.

First, the can-body supply mechanism is operated while rotating the rotary shaft 13 at a constant speed, and the can bodies K are conveyed over to the can-body holding mechanisms 15 at the supply position of can bodies, and are picked up by the vacuum plates 16.

As depicted in FIG. 11(*a*), when the rotary shaft 13 is further rotated, the female die 30 begins to move forwardly (A1), and simultaneously the male die 35 is caused to move forwardly at a speed greater than the female die 30 (B1) and is inserted into the can body K.

Subsequently, as depicted in FIG. 11(*b*), when the female die 30 begins to crimp the open end of the can body K, the male die 35 begins to move rearwardly at a slow speed (B2). Accordingly, the reduced-diameter portion KA of the can body K is pulled in the extended direction due to frictional force exerted between the outer peripheral surface of the male die 35 and the can body K, so that the can body K is less susceptible to wrinkling and buckling.

In the foregoing, it is preferable that the speed of movement of the male die 35 in the rearward direction as at B2 ranges from 10% to 20% of the speed of the female die 30 for movement in the forward direction. If the speed of the male die 35 is less than 10% of the speed of the female die 30, wrinkling and buckling cannot be prevented effectively. On the other hand, if the speed exceeds 20%, sliding marks or flaws might occur on the inner peripheral surface of the can body K.

When the reduced-diameter portion reaches a prescribed length, the male die 35 and the female die 30 are both caused to move rearwardly (A2, B3) and released from the can body K. The can body K thus processed is conveyed at the ejection position to the device for the next step, so that one cycle is completed. Thereafter, the same procedures are repeated in the respective crimping mechanisms 21.

In the aforesaid method, the male die 35 is caused to move at a slow speed while the reduced-diameter portion KA of the can body K is extended along the outer peripheral surface of the male die 35. Therefore, a uniform frictional force is exerted on the reduced-diameter portion KA so as to pull it in the extended direction, and hence wrinkles and buckles are prevented from occurring. Accordingly, it is possible to process thin can bodies without causing any defects thereon, resulting in a reduction of cost. In addition, inasmuch as the can bodies are less susceptible to wrinkles and buckles, the processing speed can be increased substantially, thereby enhancing productivity.

Moreover, the male die 35 and the female die 30 are simultaneously driven by a single complex cam 45. Therefore, it is easy to synchronize the movements of both the dies to achieve an optimal relative movement while keeping the amount of movement and the moving speed at desired values, so that the reliability of the operation is sufficiently great. Accordingly, the aforesaid method, which could not be carried out by any conventional devices, can be conducted successfully. In addition, since plural drive devices are not required, the apparatus is of a simple construction, resulting in reduction in cost.

Furthermore, in the illustrated embodiment, the complex cam 45 is maintained stationary, and the plurality of crimping mechanisms 21, secured to the rotary shaft 13, are rotated along the circumference of the complex cam 45 to drive the male die 35 and the female die 30 axially of the shaft 13. Therefore, the supply and ejection of the can bodies K can always be carried out at prescribed positions, and hence the movement of the can bodies from the previous step to the next step can be made smooth, thereby further enhancing productivity.

Moreover, in the mounting structure of the dies for the aforesaid apparatus, when the screw **29*e* is tightened, the clamping claws 29 are slided rearwardly along the inclined surface 23*c* of the outer cylinder 23, and the rearward end of the female die 30 is clamped by the hook 29*a* with the rearward end face of the female die 30 pressed against the forward end face of the larger-diameter portion 23*b*, so that the female die 30 can be firmly secured to the outer cylinder 23 in a coaxial manner. Accordingly, pressure exerted on the female die 30 in a radial direction is lessened. Hence, even though the female die is made of cemented carbide, which is inferior in toughness, the female die 30** is less susceptible to cracks, or the like.

In addition, the clamping claws 29 are simple in structure and protrude slightly in the radially outward direction. The clamping claws 29 are arranged around the outer cylinder 23 in circumferentially spaced relation. Therefore, the spacing between adjacent pairs of crimping mechanisms 21 can be made small by shifting the adjacent clamping claws 29 from each other, and hence a great number of crimping mechanisms 21 can be arranged around the rotary shaft 13.

Furthermore, each of the clamping claws 29 is urged outwardly by a respective spring **29*g* wound around the screw 29*e*. Therefore, when the screw 29*e* is loosened, the clamp claw 29 is caused to move outwardly, so that the releasing of the female die 30** can be carried out very easily.

In the foregoing, although the protrusion **30*b* is formed on the female die 30 so as to extend along the entire circumference, it may be replaced by a plurality of protrusions formed only at positions where the clamping claws 29** are arranged.

Obviously, numerous modifications and variations of the present invention are possible in light of the above teachings. It is therefore to be understood that within the scope of the appended claims, the invention may be practiced otherwise than as specifically described herein.

What is claimed is:

1. A method for crimping an open end of a can body by using a male die having a diameter smaller than the diameter of the can body and a female die having a processing surface of crimping the open end, which comprises:

inserting said male die into the can body through the open end in such a manner as to be coaxial therewith;

causing said female die to fit on said open end, and keeping said female die moving along the outer peripheral surface of the male die toward said can while moving said male die, inserted into said can body, in a releasing direction from the can body at a speed of 10–20% of the speed of movement of said female die toward said can, such that the opening end is crimped by the relative movement of said male and female dies so as to have a reduced diameter; and (c) releasing said male and female dies out of engagement with said can body.

2. An apparatus for crimping an open end of a can body of a prescribed diameter, comprising:

at least one crimping means including a cylindrical male die having a diameter smaller than the can body and adapted to be inserted into the can body through the open end, a cylindrical female die disposed generally coaxially with said male die and having a processing surface for processing the open end of the can body, and first and second follower members being connected to said male and female dies, respectively;

holding means disposed adjacent to said at least one crimping means for holding said can body at such a position that the open end of the can body is opposed to said male and female dies in a generally coaxial relation therewith; and cam means associated with said first and second follower means of said at least one crimping means, said cam means having first and second cam faces with which said first and second follower members are respectively held in engagement; and drive means operably connected to said at least one crimping means for moving said first and second follower members axially of said male and female dies along said first and second cam faces in a prescribed manner and including means for moving said female die toward said can for crimping an open end thereof while moving said male die in a releasing direction from said can at a speed 10–20% of the speed of movement of said female die toward said can.

3. An apparatus as defined in claim 2, wherein said crimping means further comprises a hollow outer cylinder disposed so as to be slidable axially of said male and female dies and an inner cylinder accommodated in said outer cylinder for sliding movement relative to said outer cylinder, said inner cylinder being securely fixed to said male die and connected to said first follower member while said outer cylinder is securely fixed to said female die and connected to said second follower member.

4. An apparatus as defined in claim 3, wherein said cam means comprises a complex cam disposed stationary and including an annular portion having said first and second cam faces.

5. An apparatus as defined in claim 4, wherein said annular portion of said complex cam has opposite end faces and an outer peripheral surface connecting said opposite end faces, said annular portion having a groove formed in said outer peripheral surface so as to extend circumferentially thereof, said groove defining said first cam face while said opposite end faces define said second cam faces.

6. An apparatus as defined in claim 5, wherein said first follower member includes a first roller held in rolling contact with said first cam face while said second follower member includes a pair of second rollers held in rolling contact with said second cam faces, respectively.

7. An apparatus as defined in claim 2, further comprising a base, wherein said drive means comprises a rotary shaft supported on said base for rotation and a drive source operably connected to said rotary shaft for rotating the rotary shaft.

8. An apparatus as defined in claim 7, wherein said holding means comprises a support member fixedly mounted on said rotary shaft for rotation therewith and at least one vacuum member mounted on said support member for securely holding said can body.

9. An apparatus as defined in claim 8, wherein a plurality of said crimping means are disposed around said rotary shaft in circumferentially spaced relation to one another so as to be rotatable with the shaft, said holding means including a plurality of said vacuum members arranged on the support member in circumferentially spaced relation to one another so as to correspond to the crimping means, respectively.

10. An apparatus as defined in claim 2, wherein said crimping means further comprises means for supplying an interior of the can body with pressurized air to prevent deformation of the can body during the crimping operation.

11. An apparatus as defined in claim 10, wherein said crimping means includes a hollow inner cylinder, said air-supply means comprising said inner cylinder a hollow member securely fixed to said inner cylinder so as to be communicated therewith, an air passage means connected at one end to said hollow member, and a source of the pressurized air disposed outside said outer cylinder and connected to the other end of said air passage means.

12. An apparatus as defined in claim 3, wherein said female die includes a protrusion formed at a rearward end thereof, said rearward end of said female die being held in abutting contact with a forward end portion of said outer cylinder, further comprising at least one clamping member having a hook, said clamping member being disposed on said forward end portion of said outer cylinder with said hook being engaged with said protrusion.

13. An apparatus as defined in claim 12, wherein said outer cylinder has an interiorly threaded aperture disposed at the forward end portion and extending radially thereof, said clamping member including a through-bore extending generally in alignment with said aperture, further comprising at least one fastening screw inserted through said bore of said clamping member and threaded into said threaded aperture of said outer cylinder.

14. An apparatus as defined in claim 13, wherein a plurality of said clamping members are arranged around said forward end portion of said outer cylinder in circumferentially spaced relation to one another, and are securely fixed thereto by a plurality of said fastening screws, respectively.

15. An apparatus as defined in claim 14, wherein said outer cylinder has a peripheral inclined surface tapering in a direction away from the forward end thereof, said clamping member having an inclined surface complementary to said peripheral inclined surface of said outer cylinder and being slidable along said peripheral inclined surface of said out cylinder.

16. An apparatus as defined in claim 15, wherein said through-bore has a larger diameter portion, further comprising urging means housed in said larger diameter portion for urging said clamping member radially outwardly of said outer cylinder.

* * * * *